United States Patent [19]

Lamppa et al.

[11] Patent Number: 4,832,000

[45] Date of Patent: May 23, 1989

[54] WOOD-BURNING STOVE

[76] Inventors: Herbert R. Lamppa, P.O. Box 422; Daryl H. Lamppa, P.O. Box 786, both of Tower, Minn. 55790

[21] Appl. No.: 405,325

[22] Filed: Aug. 5, 1982

[51] Int. Cl.[4] ..... F24C 1/14

[52] U.S. Cl. ..... 126/77; 126/66

[58] Field of Search ..... 126/77, 76, 121, 312, 126/143, 60, 63, 66, 67, 293, 123; 98/48

[56] References Cited

U.S. PATENT DOCUMENTS

| | | | |
|---|---|---|---|
| 2,345,519 | 3/1944 | Wingert | 126/77 |
| 4,111,181 | 9/1978 | Canney | 126/77 |
| 4,117,824 | 10/1978 | McIntire et al. | 126/77 |
| 4,141,336 | 2/1979 | Fitch | 126/121 |
| 4,184,473 | 1/1980 | McIntire et al. | 126/66 |
| 4,200,086 | 4/1980 | Kolb | 126/77 |
| 4,207,860 | 6/1980 | Schrock | 126/77 |
| 4,232,650 | 11/1980 | Frank | 126/77 |
| 4,265,213 | 5/1981 | Gorsuch et al. | 126/66 |
| 4,360,000 | 11/1982 | Down | 126/77 |
| 4,392,477 | 7/1983 | Milligan | 126/77 |

*Primary Examiner*—James C. Yeung

*Attorney, Agent, or Firm*—Gerald F. Chernivec

[57] ABSTRACT

A wood-burning stove comprising a body providing a primary combustion chamber and a secondary combustion chamber, primary air supply means to supply preheated air at lower and intermediate levels of the primary chamber, secondary air supply means to supply preheated air to the secondary chamber, and temperature actuated control means to regulate the supply of primary combustion air based on the temperature of flue gases entering the secondary combustion chamber.

17 Claims, 4 Drawing Sheets

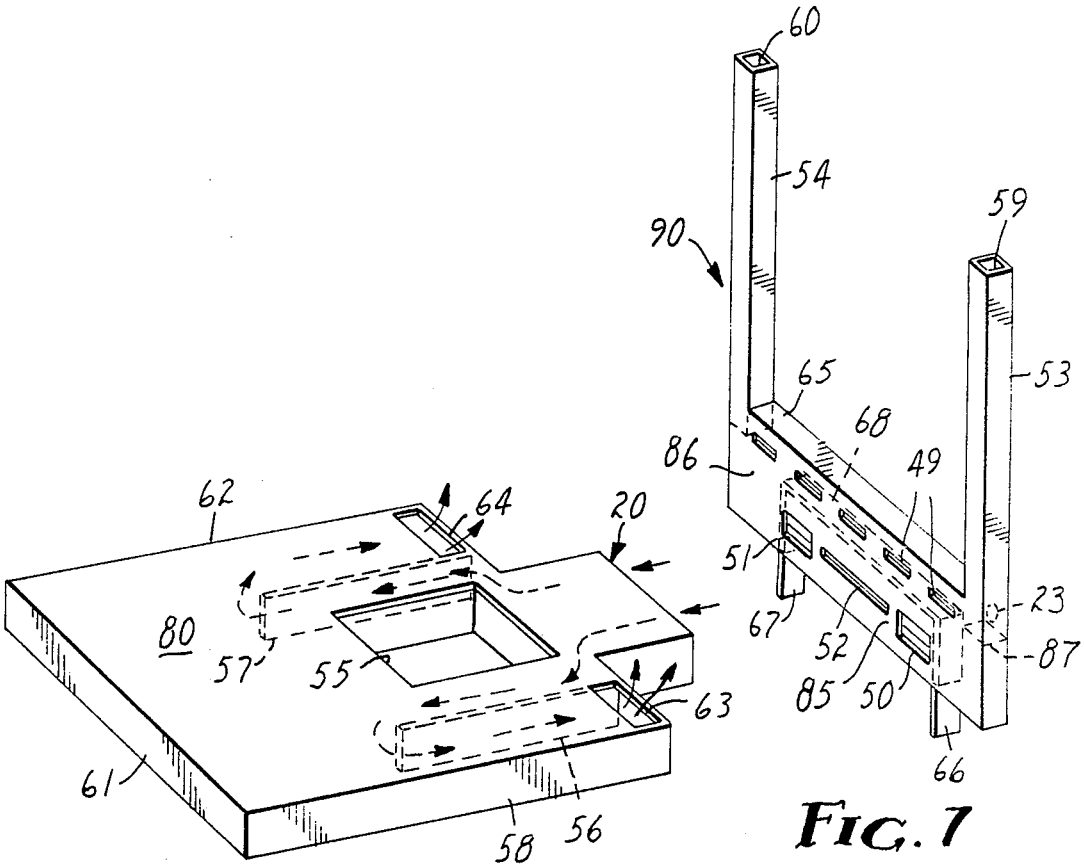
FIG. 6
FIG. 7
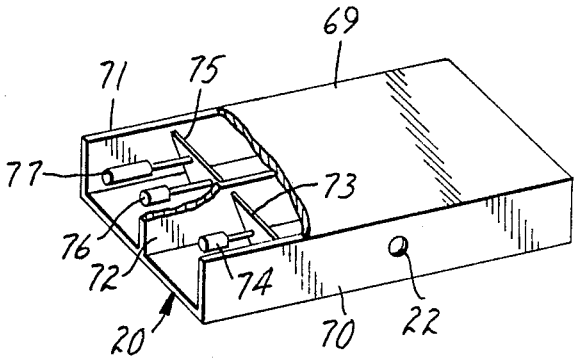
FIG. 8

WOOD-BURNING STOVE

BACKGROUND OF THE INVENTION

The present invention relates to a free-standing wood-burning stove and particularly to a stove capable of exhibiting increased efficiency and economy of operation.

With the advent of increasing costs of fuels based on petroleum or natural gas, and the increasing possibility of the shortage of same, wood-burning stoves and heaters are enjoying a tremendous increase in popularity.

Conventional fireplaces, although attractive, are extremely inefficient and are not particularly adapted for use other than small area heating, and even that can be rather ineffective. Furthermore, conventional fireplaces typically cannot be conveniently controlled or regulated as to heat level or rate of combustion.

Free-standing or Franklin type stoves have the distinct advantage of greater heat utilization, while providing some of the attractiveness of the open fire of a fireplace. However, most stoves of this general type are rather inefficient in operation. For example, most of such stoves, regardless of claims to the contrary, produce visible smoke, which indicates inefficiency in operation.

Furthermore, the room heating possibilities of many of these stoves are not utilized other than simply via radiation to the surroundings, i.e., heating of ambient air only occurs through radiation from the walls of the stove.

Efficiency of stove operation relates to maximizing the completeness of combustion of the wood and volatile products, such as creosote, which result therefrom. Combustion is of course a chemical reaction releasing heat, with oxygen being the sole supporter necessary therefor. To maximize combustion, there must be found the precise proportion of oxygen required to combust the fuel, a thorough and complete mixing of the fuel and oxygen, and a sufficiently high temperature to promote rapid combination of oxygen with the existing fuel.

A measure of the efficiency of a stove is simply the effluent gas therefrom. Carbon, in the form of smoke, represents a serious inefficiency and waste of potential fuel. Similarly, the emission of carbon monoxide in the flue gas indicates inefficiency in operation.

There have been numerous approaches to increasing the efficiency of wood burning stoves in the prior art. In U.S. Pat. No. 4,182,304, there is disclosed a downdraft stove where the primary air for combustion is forced through the hot coals of the burned fuel. In U.S. Pat. No. 4,201,185, a thermostat system is placed within an air circulation chamber surrounding the combustion chamber which is connected to the primary combustion air draft control. In U.S. Pat. No. 4,232,653, primary combustion air is provided through a special orifice arrangement by a motor driven blower which is energized by a room thermostat.

All the foregoing provide attempts to optimize the efficiency of combustion when utilizing wood as the combustible fuel. However, we are presently not aware of a commercially available wood-burning stove which operates substantially without production of visible smoke.

Conversely, our wood burning stove is capable of burning substantially without visible effluent when the outside temperature is greater than about 20° F., and during colder temperatures, in essence the only visible effluent is steam, signifying substantially perfect combustion.

In order to burn wood so that no visible smoke or creosote is produced, which is up to about 98 percent of the burn period, we have found that sufficient quantities of preheated air must be provided at differing levels within the combustion chamber. Furthermore, the lower level air must enter the primary combustion zone indirectly so that it does not flow or impinge directly onto the wood, thereby not igniting any more wood than the available air can combust. This lower level air feeds the front of the wood fuel with oxygen, and as the fuel burns backward, the heat produced by the reaction gradually induces the release of volatile liquids, which instantaneously gasify, from the remaining unburned portions of the wood. At the intermediate air level within the primary combustion zone, these gases combine with pre-heated air, and substantially complete combustion occurs. The balance of these unburned gases travel upward into a secondary combustion zone, where they pass through a layer of oxygen-rich preheated air, whereupon the combustion process is completed.

In our combustion chamber, with its primary and secondary combustion zones, the top, front, and sides are sufficiently insulated to insure that the reaction temperature therein remains at the necessary level for combustion to proceed. A temperature sensor at the entrance to the secondary combustion zone provides a signal to an automatic multi-stage control system for regulating the quantity of combustion air entering the primary combustion zone at the lower and intermediate levels.

Prior patents typically discuss "primary" or "secondary" air utilized in the operation of a stove, but we have found that the three levels of air in our stove act, at various stages of the combustion process, as both primary or secondary air. For example, when the primary combustion draft is open, some of the lower level air acts as both primary and secondary air, while the intermediate level air functions in the same manner. The secondary combustion zone air at this stage of the stove operation is strictly secondary in nature. However, when the primary combustion draft closes, and the stove begins to idle, the fire obtains its necessary combustion air (both primary and secondary) through a continuously open small draft damper, while the secondary combustion air is provided through continuously open draft dampers in the stove exterior. These dampers provide a steady flow of air into the secondary combustion zone at all times, thereby providing the necessary amount of air not available via the primary combustion draft, assuring virtually perfect combustion.

These features of using three distinct levels for providing combustion air, plus the concept of controlling the combustion chamber temperature by regulating the combustion air entering the primary combustion zone has been found to provide substantially smokeless stove operation.

In this fashion, our stove can burn wood containing a relatively high moisture content, at a controlled rate, with no visible effluent. In fact, if a filter paper is utilized to check the effluent of our stove, typically only traces of carbon will be found.

BRIEF DESCRIPTION OF THE DRAWINGS

FIGS. 6 and 7 are perspective views of the disassembled component parts of the air distribution system of FIG. 5; and FIG. 8 is an enlarged detailed view of the primary combustion air draft damper control.

DETAILED DESCRIPTION

Figure 1:
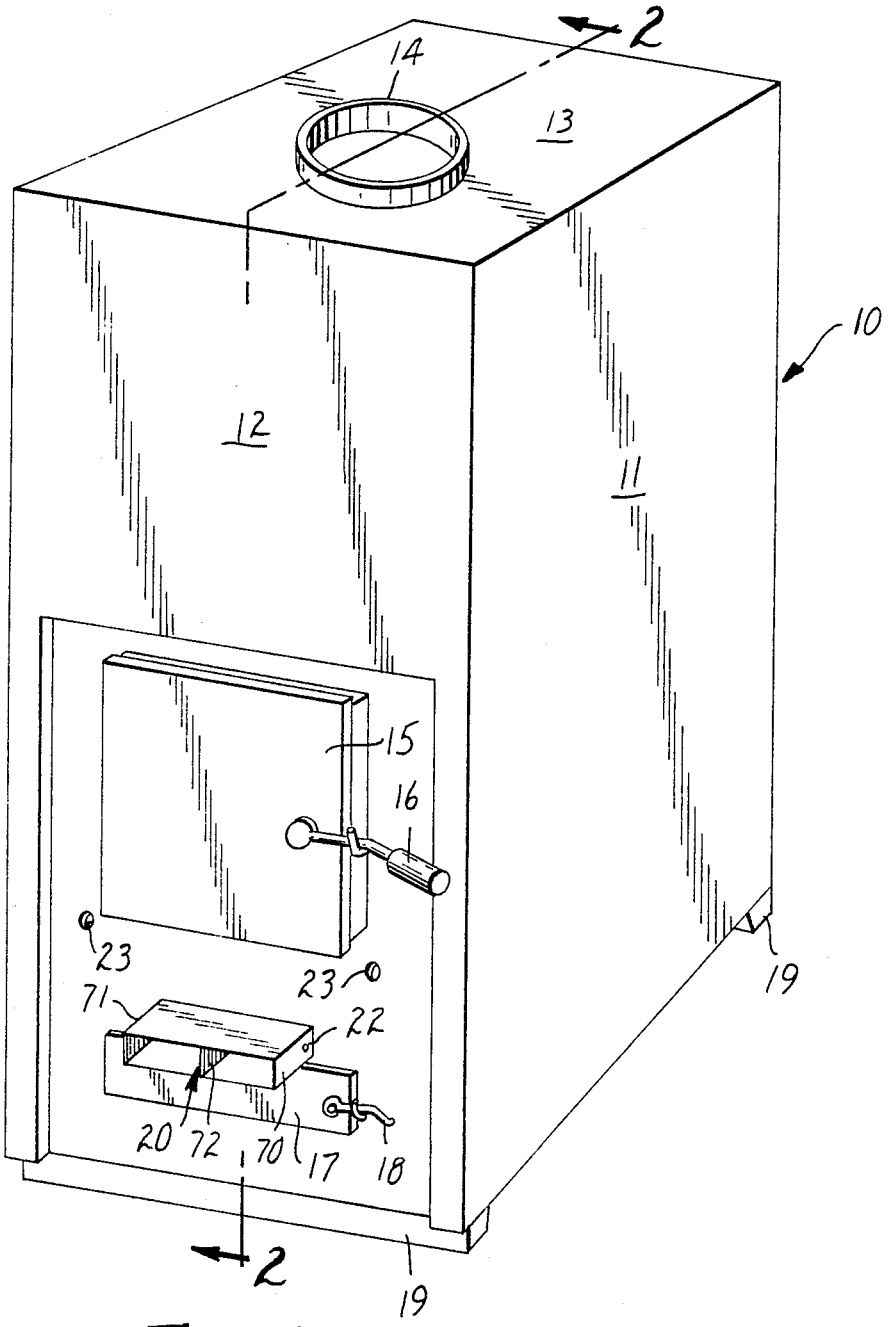
FIG. 1 is a perspective view of a stove according to the present invention.
Figure 2:
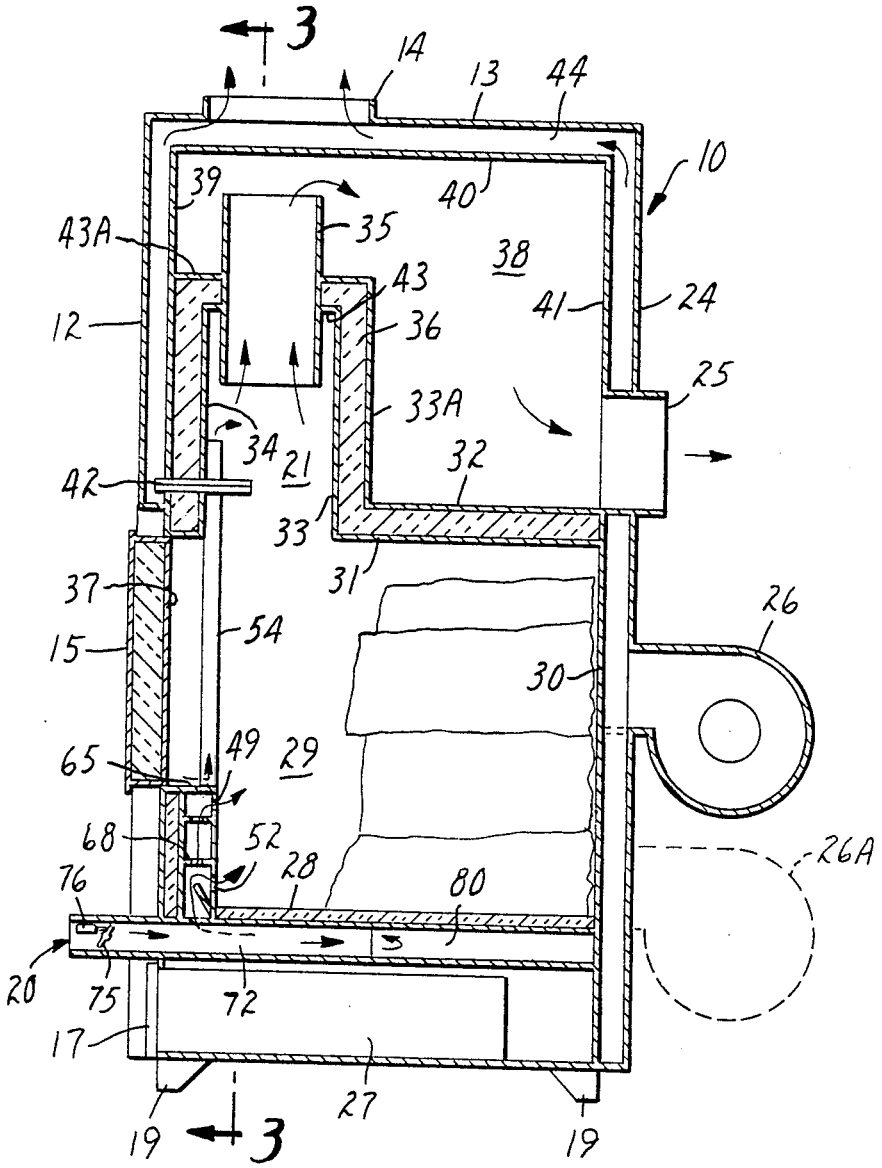
FIG. 2 is a cross-sectional view taken along the line 2—2 of FIG. 1.
Figure 3:
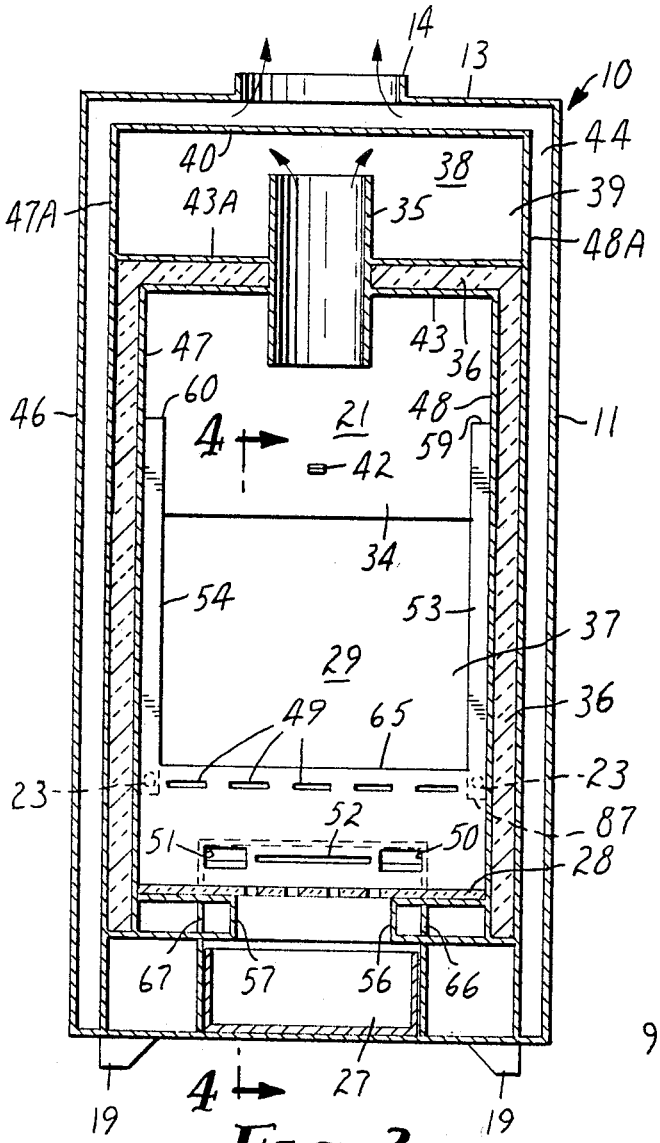
FIG. 3 is a front sectional view taken along the line 3—3 of FIG. 2.
Figure 4:
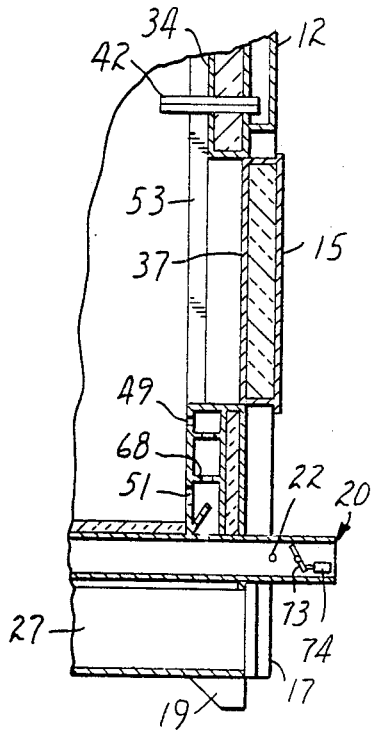
FIG. 4 is a partial cross-sectional view taken along line 4—4 of FIG. 3.
Figure 5:
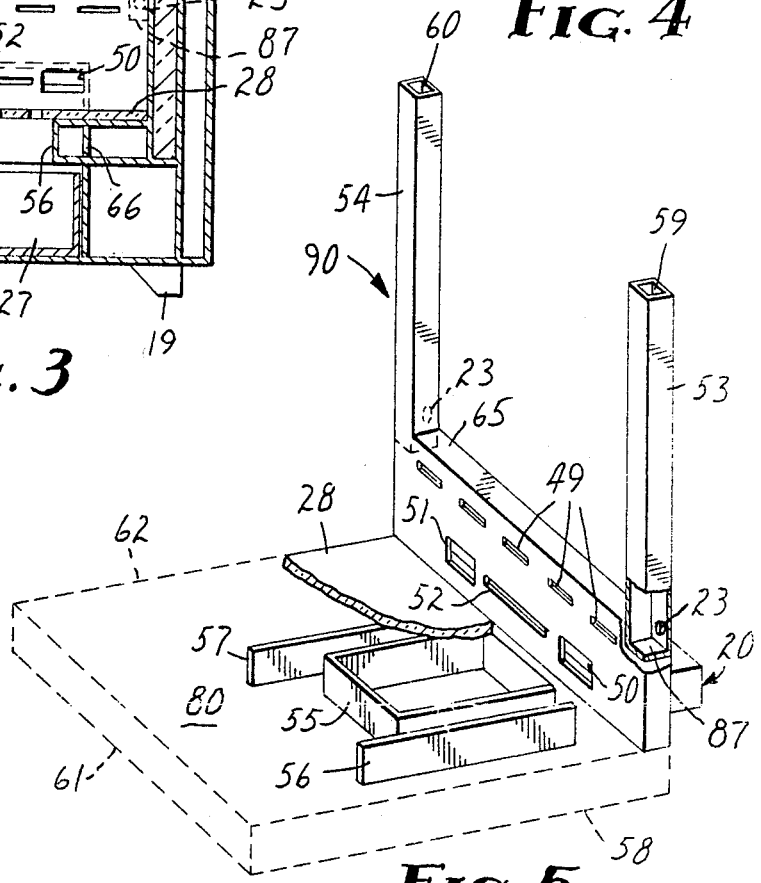
FIG. 5 is a perspective view of the air distribution system of our stove.

Referring to the drawings, like reference numerals apply to similar parts throughout the similar views, and FIGS. 1-3 illustrate our stove 10 including a housing defined by walls 11 and 46, a top 13 containing therein warm air collar 14 through which warm air can exit to the desired comfort zone via ductwork attached to collar 14 (not shown), front 12, support base or legs 19, and rear 24, containing therein flue gas collar 25 through which flue gas can exit to the outside via ductwork attached to collar 24 (not shown). In front wall 12 is shown fuel access door 15 having opening means 16, the door typically being hinged (not shown). Ashpan access door 17 with opening means 18 is also typically hinged (not shown), and allows access for removal of ashpan 27. Primary combustion air enters stove 10 via inlet conduit 20, as illustrated more clearly in later drawings. Continuously open draft damper 22 allows passage of primary combustion air when stove 10 is idling, and secondary combustion air is provided through conduits 53 and 54 into secondary combustion zone 21 (FIG. 3) via continuously open draft dampers 23.

In FIGS. 2 and 3, primary combustion chamber 29 is defined by sides 47, 48, top 31, and front 34 (with the inside surface 37 of fuel door 15 comprising a portion of the front wall). These surfaces of primary combustion zone 29 are all insulated, shown generally in all views by crosshatched portions 36, so as to maintain maximum temperature therewithin. Insulation 36 can consist of conventional materials such as firebrick, etc.

The base of primary combustion zone 29 comprises a grate member 28 upon which the wood to be combusted is placed. Rear wall 30 of primary combustion zone 29 is uninsulated so as to allow the rear portion of the fuel to remain as cool as possible. This is because wood fuel is known to pyrolyze at temperatures approximating 500° F., i.e., chemically breakdown in the absence of oxygen.

Secondary combustion zone 21 is in open communication with the front portion of primary zone 29 and is defined by common front wall 34, common side walls 47, 48, and rear wall 33. Secondary zone 21 is also insulated by insulation 36, with a flue gas collar 35 therein in collar 35, as upper wall 43 thereof to allow flue gas to exit into flue gas chamber 38. An air plenum chamber 44 surrounds at collar 35, as illustrated, should extend downward into the secondary combustion zone to insure adequate mixing of combustible gases with oxygen before exiting into flue gas chamber least flue gas chamber 38, defined by outer walls 11 and 46, top 13, front wall 12 and rear wall 24 of stove 10 and walls 47A and 48A, top 40, front 39 and rear 41 of chamber 38. Air is driven through plenum chamber 44, and eventually out of collar 14, by blower 26 for heat exchange with the hot flue gases which eventually exit through flue gas exit collar 25 at rear wall 24 of stove 10. Collar 14 can connect to warm air ducts (not shown) as desired for providing room heat, and blower 26 is actuatable by thermostatic control in a comfort zone. (Not shown). If desired, an auxiliary blower 26A can be utilized to assist in cooling rear wall 24 of primary combustion zone 29 and providing heating air to plenum chamber 44.

The primary combustion air flow system, illustrated in FIGS. 4-7, comprises an air preheating chamber 80 located beneath grate member 28, which is in communication with primary inlet air conduit 20. Chamber 80 is defined by sidewalls 58 and 62, top and bottom, rear wall 61 and a front wall contiguous with inlet air conduit 20. In the front center of chamber 80, there is an opening 55 designed to allow ash to pass therethrough into ashpan 27 for subsequent removal. Preferably, chamber 80 contains baffles 56 and 57 therewithin to increase the residence time of the primary combustion air therein, as illustrated in FIG. 6, and thus increase the preheat of the primary combustion air. Similarly, to provide for greater preheat and control of air flow, openings 63 and 64 are provided for dual entrance of preheated primary combustion air into primary combustion air distribution chamber 90.

FIG. 7 illustrates air distribution chamber 90 which is a component part of the combustion air distribution system. Dividers 66 and 67, when assembled with chamber 80, provide a natural split, based on the combusting fuel within primary combustion zone 29, in the flow of primary combustion air between lower combustion air distributor 85, defined by dividers 66 and 67, top 68 and a common base (not shown), and intermediate combustion air distributor 86, defined by the outer walls of secondary combustion air duct members 53 and 54, top 65 and a common base (not shown).

A preferred function of the lower combustion air distributor 85 is to force the bulk of the combustion air into the outer edges of primary combustion zone 29, while still providing sufficient air to keep the front center of the wood fuel ignited. Furthermore, this design aids in dispersing the air as it enters primary combustion zone 29 to provide indirect flow thereby not boring into the wood fuel directly and causing the ignition of more wood than there is available air for complete combustion.

Baffled inlet openings 50 and 51 are of sufficient size to insure that the maximum air flow is at the outward front edges of the fuel load and are positioned at the outward edges of lower air distributor 85. To insure that the front center of the wood fuel remains ignited, horizontal slot 52 is provided, which is of sufficient length to substantially traverse the distance between openings 50 and 51. Openings 50 and 51 and slot 52 are in essence positioned at the base front of the wood fuel load.

In essence, baffled ports 50 and 51 and slot 52 are of such size, shape and location to provide even, indirect dispersement of air flow across the face front of the wood fuel while minimizing the boring or penetration of the fire too deeply therein. Designs other than that specifically shown are obviously equally applicable.

Intermediate air distributor 86 has somewhat the same function as that of the lower air distributor 85. As illustrated, this distributor is elevated above the base frontal of the wood fuel and has a number of horizontal slots 49 for even, indirect and dispersed air flow. Again, the provision of a dispersed air flow to the wood fuel is desired, and other designs are equally applicable. Intermediate distributor 86 is designed to insure supply of air for complete combustion, including the combustion of vapors produced during the burning cycle of wood fuel.

Secondary combustion zone 21 is provided to optimize completeness of the combustion reaction. Accordingly, secondary combustion air conduits 53 and 54, each having a base 87 and walls within distributor 86 (FIG. 5), are provided which have inlet draft dampers 23 and outlet ports 59 and 60. Conduits 53 and 54 are vertical and are positioned at the front of stove 10 near outside walls 47 and 48 of secondary combustion zone 21. They must be of sufficient height to insure that the air flowing from ports 59 and 60 will not flow downward but will flow with the effluent flue gases leaving primary combustion chamber 29. The purpose of conduits 53 and 54 is to mix additional oxygen-rich air with the effluent flue gases to insure complete combustion and yet not act as primary combustion air to ignite additional wood fuel.

Inlet dampers 23 should be located as near the bottom of conduits 53 and 54 as is practical to provide optimum preheat to the secondary combustion air. Dampers 23 can be simply openings cut into conduits 53 and 54 and open to ambient air, or they can contain conventional screw and plate means to provide variable proportions of openings of dampers 23, as desired.

Primary combustion air conduit 20 provides for automatically variable proportional air flow based on a temperature signal from a thermocouple in thermocouple holder (the combination designated as 42). As illustrated in FIG. 8, inlet conduit 20 is split by divider 72 and is defined by top 69, sidewalls 70 and 71 and a base (not shown). Dampers 73 and 75 are shown in the two channels formed by divider 72, as are solenoid valves 74, 76 and 77. Before the wood fuel charge is ignited, both dampers are wide open and solenoids 74, 76 and 77 are energized from a control housing (not shown). As the temperature in primary combustion zone 29 attains a preset temperature as registered by thermocouple 42 output to a control housing (not shown), a signal to solenoid 74 de-energizes same and the spring loading (not shown) of solenoid 74, closes damper 73. As the fire in primary combustion zone 29 intensifies, a second preset temperature is attained whereby damper 75 will partially close by virtue of the relaxation of solenoid 76 and the spring loading thereof. Only partial closing will occur because of solenoid 77. As the fire continues to intensify, a third preset temperature in the control housing (not shown) will be attained, whereby solenoid 77 will relax and damper 75 will close entirely. The fire will then continue to burn from primary combustion air delivered through supplemental damper 22. Damper 22 can be simply an opening in conduit 20, or it can contain conventional screw and plate means to provide variable proportions of opening thereof, as desired.

Additional stages can be provided to even more closely control primary combustion air flow, but we have found the design illustrated to be sufficient for smokeless operation of stove 10.

The present control temperatures can be varied considerably without detracting from the capability of the stove to operate smokeless, i.e., exremely efficiently.

Means for providing automatic control of primary combustion air other than the solenoid valves can of course be utilized, and are to be considered within the scope of our invention. Furthermore, temperature sensing means other than the thermocouple assembly illustrated are similarly to be considered within the scope of our invention.

In the operation of our stove, primary combustion air passes into pre-heating assembly 80 via conduit 20. The air, upon passing into pre-heating assembly 80, splits in two directions and reverses its path back towards the front of stove 10 via baffles 56 and 57, becoming preheated during this time, and then flowing through channels 63 and 64 further defined by dividers 66 and 67. At this point, the now-expanded volume of air is again split, some of the air flowing into lower air distributor 85 in communication with openings 50, 51 and 52, the balance flowing into intermediate air distributor 86 and passing upward to exit as intermediate air through slots 49. During the burn, there is a constant flow of air through continuously open dampers 23, the air passing up through conduits 53 and 54 to thereby enter secondary combustion zone 21. With this additional air present, any unburned gases, which are at the appropriate temperature, combust to complete the reaction sequence.

What is claimed is:

1. A wood-burning stove comprising:

(a) A stove body containing a combustion chamber comprising a primary combustion zone for receiving wood to be burned and a secondary combustion zone in open communication therewith;

(b) Primary combustion air supply means operable to supply preheated primary combustion air to said primary combustion zone at lower and intermediate levels therein, said primary combustion air supply means comprising a preheating chamber disposed beneath said combustion chamber and a conduit open to the exterior atmosphere in communication with said preheating chamber, and multistage draft damper means disposed in said conduit, said damper means automatically operable responsive to a signal from a temperature measuring device, said signal being generated responsive to the temperature of the flue gas entering said secondary combustion zone;

(c) Secondary combustion air supply means operable to supply preheated secondary combustion air to said secondary combustion zone.

2. The stove of claim 1 with grate means forming the floor of said combustion chamber for supporting said wood, and a removable ash pan disposed beneath said combustion chamber and communicating therewith through said grate means.

3. The stove of claim 1 with said damper means operable by solenoid valves.

4. The stove of claim 3 with a first valve operable to regulate a first damper position at a preset flue gas temperature; a second valve operable to regulate a second damper position at a preset flue gas temperature; and a third valve operable to further regulate said second damper position at a present preset flue gas temperature.

5. The stove of claim 1 wherein said primary combustion air supply means contains a continuously open supplemental draft damper of sufficient air capacity to support minimum combustion of wood in said primary combustion zone.

6. The stove of claim 5 further containing means operable to adjust the air flow capacity of said supplemental damper.

7. The stove of claim 1 wherein said secondary combustion air supply means disposed within said primary combustion zone further contains a continuously open draft damper in communication with the exterior atmosphere operable to supply air to said secondary combustion zone.

8. The stove of claim 7 further containing means operable to adjust the air flow capacity of said damper.

9. The stove of claim 7 wherein said secondary combustion air supply means comprises at least two conduits extending vertically from substantially the base of said primary combustion zone into said secondary combustion zone.

10. The stove of claim 1 further containing a flue gas chamber in communication with said secondary combustion zone.

11. The stove of claim 10 further containing a plenum chamber surrounding at least said flue gas chamber.

12. The stove of claim 11 further containing a blower disposed in said plenum chamber operable when actuated to impel air therethrough, thermostatic means responsive to the air temperature in a comfort zone to be heated by said stove to actuate said blower when said thermostatic means calls for heat and deactuate said blower when said thermostatic means does not call for heat.

13. The stove of claim 1 wherein said temperature measuring device is a thermocouple.

14. A wood-burning stove comprising:

(a) A stove body containing a combustion chamber comprising a primary combustion zone for receiving wood to be burned and a secondary combustion zone in open communication therewith;

(b) Primary combustion air supply means operable to supply preheated primary combustion air to said primary combustion zone at lower and intermediate levels therein;

(c) Lower level primary combustion air distributor means to provide dispersed air indirectly to the base of said wood, said distributor means containing baffled openings at the outward edges thereof to provide a majority of the lower level air at the outer edges of the wood and a slotted opening between said baffled openings to provide sufficient lower level air to maintain combustion at the center of the base of said wood;

(d) Secondary combustion air supply means operable to supply preheated secondary combustion air to said secondary combustion zone;

(e) Temperature actuated control means, responsive to the temperature of flue gases entering such secondary combustion zone, to regulate said primary combustion air supply means.

15. A wood-burning stove comprising:

(a) A stove body containing a combustion chamber comprising a primary combustion zone for receiving wood to be burned and a secondary combustion zone in open communication therewith;

(b) Primary combustion air supply means operable to supply preheated primary combustion air to said primary combustion zone at lower and intermediate levels therein;

(c) Intermediate level primary combustion air distributor means operable to provide dispersed air indirectly above the base of said wood;

(d) Secondary combustion air supply means operable to supply preheated secondary combustion air to said secondary combustion zone;

(e) Temperature actuated control means, responsive to the temperature of flue gases entering such secondary combustion zone, to regulate said primary combustion air supply means.

16. The stove of claim 15 further containing multiple horizontal slotted openings extending substantially the entire width of said intermediate air distributor means.

17. A wood-burning stove comprising:

(a) A stove body containing a combustion chamber comprising a primary combustion zone for receiving wood to be burned and a secondary combustion zone in open communication therewith, wherein the walls of said primary combustion zone are insulated with the exception of the rear wall thereof, and the walls of said secondary combustion zone are insulated;

(b) Primary combustion air supply means operable to supply preheated primary combustion air to said primary combustion zone at lower and intermediate levels therein;

(c) Secondary combustion air supply means operable to supply preheated secondary combustion air to said secondary combustion zone;

(d) Temperature actuated control means, responsive to the temperature of flue gases entering such secondary combustion zone, to regulate said primary combustion air supply means.

* * * * *